US005410218A

United States Patent [19]

Hush

[11] Patent Number: 5,410,218

[45] Date of Patent: Apr. 25, 1995

[54] ACTIVE MATRIX FIELD EMISSION DISPLAY HAVING PERIPHERAL REGULATION OF TIP CURRENT

[75] Inventor: Glen F. Hush, Boise, Id.

[73] Assignee: Micron Display Technology, Inc., Boise, Id.

[21] Appl. No.: 77,181

[22] Filed: Jun. 15, 1993

[51] Int. Cl.[6] ..... G09G 3/10

[52] U.S. Cl. ..... 315/169.1; 315/169.3; 315/169.4; 315/366

[58] Field of Search ..... 315/169.1, 169.3, 169.4, 315/366, 350, 172, 173, 167; 313/309, 336

[56] References Cited

U.S. PATENT DOCUMENTS

| | | | |
|---|---|---|---|
| 4,326,151 | 4/1982 | Weisbrod | 315/366 |
| 4,349,816 | 9/1982 | Miller et al. | 315/169.3 X |
| 4,554,539 | 11/1985 | Graves | 315/169.3 X |
| 4,857,799 | 8/1989 | Spindt | 313/495 |
| 4,866,349 | 9/1989 | Weber et al. | 315/169.4 |
| 4,908,539 | 3/1990 | Meyer | 315/169.3 |
| 5,103,144 | 4/1992 | Dunham | 315/366 |
| 5,103,145 | 4/1992 | Doran | 315/381 |
| 5,153,483 | 10/1992 | Kishino et al. | 315/3 |
| 5,162,704 | 11/1992 | Kobori et al. | 315/349 |
| 5,210,472 | 5/1993 | Casper et al. | 315/169.1 X |
| 5,283,500 | 2/1994 | Kochanski | 315/58 |
| 5,313,140 | 5/1994 | Smith et al. | 315/169.1 |

FOREIGN PATENT DOCUMENTS

| | | | |
|---|---|---|---|
| WO92/05571 | 4/1992 | European Pat. Off. | 315/169.1 |

*Primary Examiner*—Robert J. Pascal
*Assistant Examiner*—Haissa Philogene
*Attorney, Agent, or Firm*—William R. Bachand; Ozer M. N. Teitelbaum

[57] ABSTRACT

A Field Emission Display ("FED") is disclosed having an array of display grids formed within a region of a semiconductor substrate. The array is defined by a number of rows and a number of columns. Further, a multiplicity of field emitter tips are incorporated for driving the array, each of the tips being coupled with a display grid of the array. To select any row of the array, a row select switch is employed. The row select switch is preferably formed outside the region of the substrate. In operation, a row is selected when a row control signal is received by the row select switch. Further, a column select switch for selecting any of said columns is also employed, formed outside the region. In operation, a column is selected when a column control signal is received by the column select switch. Moreover, a plurality of constant current sources, formed outside the region, are provided for generating a constant current to each of the tips. Each of the constant current sources is enabled by the column control switch. Thus, the number of constant current sources is equal to the number of columns. Utilizing this configuration, a first tip drives a first grid of the array after the row select switch and the column select switch associated with the first tip are enabled.

4 Claims, 2 Drawing Sheets

ACTIVE MATRIX FIELD EMISSION DISPLAY HAVING PERIPHERAL REGULATION OF TIP CURRENT

FIELD OF THE INVENTION

The present invention pertains to Field Emission Display (FED) devices. More particularly, the invention relates to a FED design having a reduced number of constant current sources.

BACKGROUND OF THE INVENTION

Until recently, the cathode ray tube ("CRT") has been the primary device for displaying information. While having sufficient display characteristics with respect to color, brightness, contrast, and resolution, CRTs are relatively bulky and power hungry. In view of the advent of portable laptop computers, the demand has intensified for a display technology which is lightweight, compact, and power efficient.

One available technology is flat panel displays, and more particularly, Liquid Crystal Display ("LCD") devices. LCDs are currently used for laptop computers. However, these LCD devices provide poor contrast in comparison to CRT technology. Further, LCDs offer only a limited angular display range. Moreover, color LCD devices consume power at rates incompatible with extended battery operation. In addition, a color LCD type screen tends to be far more costly than an equivalent CRT.

In light of these shortcomings, there have been several developments recently in thin film, Field Emission Display ("FED") technology. In U.S. Pat. No. 5,210,472, commonly assigned with the present invention, a FED design is disclosed which utilizes a matrix addressable array of pointed, thin-film, cold field emission cathodes in combination with a phosphor luminescent screen. Here, the FED incorporates a column signal to activate a column switching driver and a row signal to activate a row switching driver. At the intersection of both an activated column and an activated row, a grid-to-emitter voltage differential exists sufficient to induce a field emission, thereby causing illumination of the associated phosphor of a pixel on the phosphorescent screen. By employing this design, the bus line associated with the current regulator has a low parasitic capacitance, thus being easier to control. Extensive research has recently made the manufacture of an inexpensive, low power, high resolution, high contrast, full color FED a more feasible alternative to LCDs.

However, the structure disclosed in U.S. Pat. No. 5,210,472, has several shortcomings. First, that architecture requires a large amount of semiconductor die space because each pixelator comprises a row select switch, a column select switch, and a constant current source within the display's array. As such, the size of the display, the packed pixel density (pixels per inch), and thus the resolution are all adversely affected. Further, that architecture effects the size of the display. By requiring a greater number of transistors, that architecture adversely affected the number of die per wafer, as well as the manufacturing yield.

Second, the architecture of U.S. Pat. No. 5,210,472 does not provide direction for a more flexible, powerful and reliable constant current source. That design does not enable a method for reducing power consumption of the overall device.

Thus, a flat panel display architecture is needed that allows for a more compact design, requires fewer transistors, and has a more flexible, powerful, and reliable constant current source, while requiring less power consumption. Moreover, an architecture is needed which can support better color and gray scale control. Further, there is a demand for a flat panel display having a more compact design. Additionally, there is a demand for a flat panel display architecture that provides a larger number of die per wafer and higher manufacturing yield, while having a reduced cost associated with its manufacture.

SUMMARY OF THE INVENTION

The primary advantage of the present invention is to eliminate the aforementioned drawbacks of the prior art.

As another advantage the present invention provides a flat panel display, and more particularly, a field emission display, having a more compact design structure.

As another advantage the present invention provides a flat panel display, and more particularly, a field emission display, that will increase the number of die per wafer, as well as manufacturing yield.

As an additional advantage, the present invention provides a flat panel display, and more particularly, a field emission display, requiring fewer transistors.

As yet another advantage, the present invention provides a flat panel display, and more particularly, a field emission display, which allows for a more powerful and reliable constant current source.

As still another advantage, the present invention provides a flat panel display, and more particularly, a field emission display, having better gray scale and color control.

As still another advantage, the present invention provides a flat panel display, and more particularly, a field emission display, having a more precise constant current source.

As still another advantage, the present invention provides a flat panel display, and more particularly, a field emission display, which is less expensive to manufacture.

Yet still another advantage of the present invention is to provide a flat panel display, and more particularly, a field emission display which requires less power.

As a further advantage, the present invention provides a flat panel display, and more particularly, a field emission display, which is more compact, has a greater packed pixel density (pixels per inch), and has improved resolution.

In order to achieve the hereinabove advantages, as well as others which will become apparent hereafter, a Field Emission Display ("FED") is disclosed having an array of displays formed within a region of a semiconductor substrate. The array is defined by a number of rows and a number of columns. Further, a multiplicity of field emitter tips are incorporated for driving the array, each of the tips being coupled with a display of the array. To select any row of the array, a row select switch is employed. In one embodiment of the present invention, each row select switch is formed outside the region of the substrate. In operation, a row is selected when a row control signal is received by the row select switch.

Further, a column select switch for selecting any of said columns is also employed, formed outside the region of the substrate. In operation, a column is selected when a column control signal is received by the column select switch.

Moreover, a plurality of constant current sources, formed outside the region of the substrate, are provided for generating a constant current to each of the tips. Each of the constant current sources is enabled by the column control switch. Thus, the number of constant current sources is equal to the number of columns. Utilizing this configuration, a first tip drives a first display of the array after the row select switch and the column select switch associated with the first tip are enabled.

Other aspects and advantages will become apparent to those skilled in the art from the following detailed description read in conjunction with the appended claims and the drawings attached hereto.

BRIEF DESCRIPTION OF THE DRAWINGS

The present invention will be better understood from reading the following description of non-limitative embodiments, with reference to the attached drawings, wherein below.

It should be emphasized that the drawings of the instant application are not to scale but are merely schematic representations and are not intended to portray the specific parameters or the structural details of the invention, which can be determined by one of skill in the art by examination of the information herein.

DETAILED DESCRIPTION OF THE INVENTION

Figure 1:
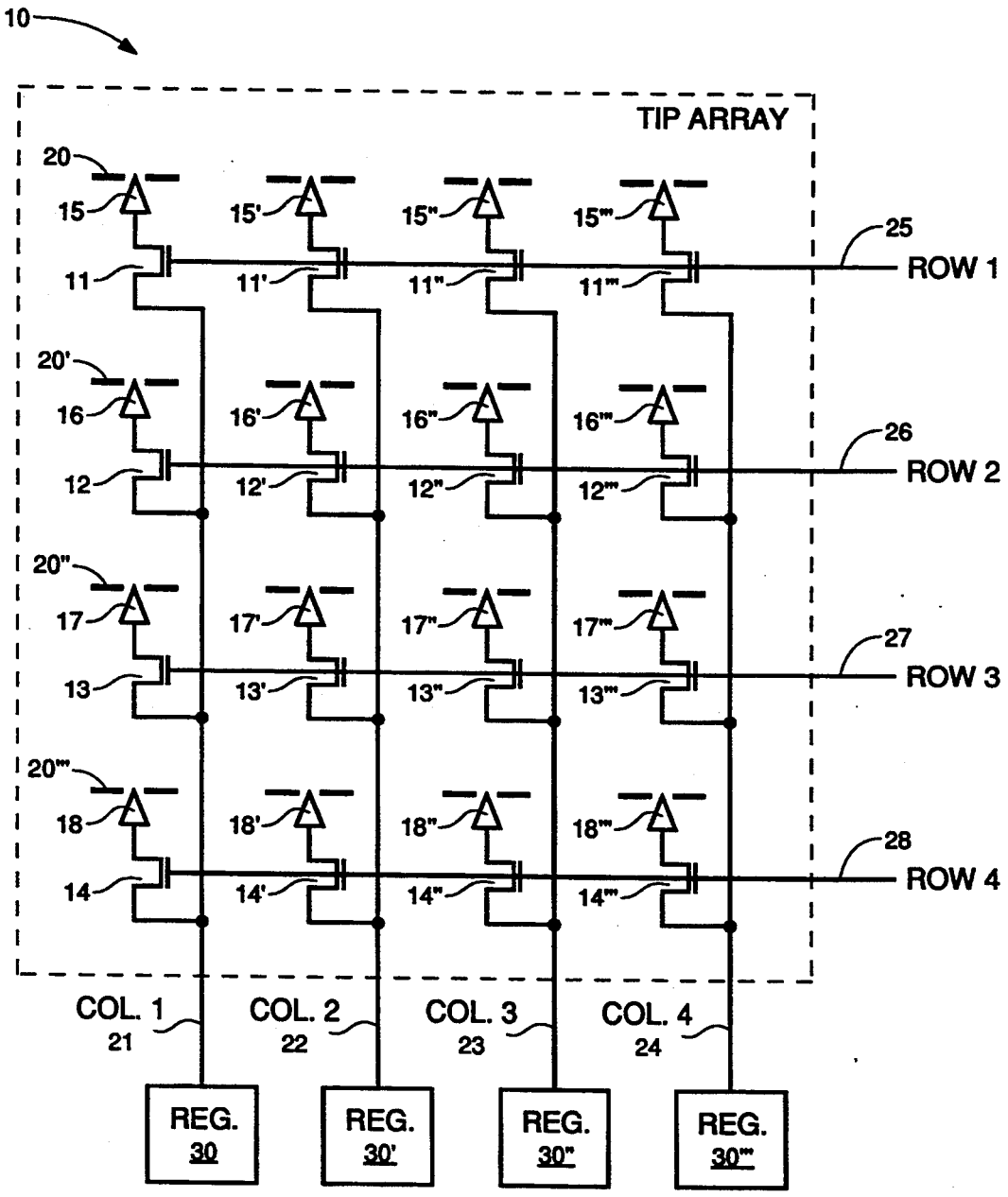
FIG. 1 is a schematic diagram of a flat panel display device employing a first embodiment of the present invention.

Referring to FIG. 1, a flat panel display device 10, preferably a field emission display ("FED"), is illustrated employing a first embodiment of the present invention. Device 10 comprises an array defined by a predetermined number of rows and columns formed within a 3 dimensional periphery or region on a semiconductor substrate. The dashed line in FIG. 1 depicts this periphery. For the purposes of illustration, the array comprises a 4 by 4 matrix addressable array, whereby the four columns are represented by the numbers 21, 22, 23 and 24, and the four rows are represented by the numbers 25, 26, 27 and 28.

In FIG. 1, device 10 comprises an array of field emitter tips 15–18, 15′–18′, 15″–18″, and 15‴–18‴ and display grids 20, 20′, 20″, and 20‴ within the substrate's region. Relying on the principles of FED technology, electrons are emitted by tips 15–18, 15′–18′, 15″–18″, and 15‴–18‴ through corresponding display grids 20, 20′, 20″, and 20‴ in order to illuminate a phosphorus background (not shown) and display an image.

In the first embodiment of the present invention, tips 15–18, 15′–18′, 15″–18″, and 15‴–18‴ are driven by a plurality of constant current sources 30, 30′, 30″, and 30‴ formed outside the substrate's region. Utilizing the advantages of FED technology, constant current sources 30, 30′, 30″, and 30‴ may comprise the pixelator driver technology described in U.S. Pat. No. 5,210,472 and incorporated herein by reference, though viable alternates may also be utilized. It should be noted that when taken in combination, tips 15–18, 15′–18′, 15″–18″, and 15‴–18‴ and constant current sources 30, 30′, 30″, and 30‴ provide a means for driving device 10, and more particularly display grids 20, 20′, 20″, and 20‴.

The above architecture is partly realized by the direct coupling of each constant current source 30, 30′, 30″, or 30‴ with one particular column, 21, 22, 23 or 24, of rows 25–28. Thus, the number of constant current sources 30, 30′, 30″, and 30‴ is directly equal to the number of columns in the matrix addressable array. As such, there are 4 constant current sources, 30, 30′, 30″, and 30‴, each being associated with one of columns 21 through 24.

Further, respectively coupled directly to each tip 15–18, 15′–18′, 15″–18″, and 15‴–18‴ is a switching device 11–14, 11′–14′, 11″–14″, and 11‴–14‴. Given the four by four size of the matrix addressable array, 16 switching devices are thus required. Switching devices 11–14, 11′–14′, 11″–14″, and 11‴–14‴ preferably comprise field effect transistors ("FET") and are grouped by rows. As such, switching devices 11–14 fall within row 25, switching devices 11′–14′ fall within row 26, switching devices 11″–14″ fall within row 27, and switching devices 11″–14″ 11‴–14‴ fall within row 28. By this grouping, a single row select signal enables an entire row, each row being coupled to one row select line.

Furthermore, constant current sources 30, 30′, 30″, and 30‴ each comprise a column select switching device (not shown) formed outside the region of the substrate. Thus, when a particular tip of the array is to be enabled for emission purposes, a column select signal is received by the relevant constant current source. Upon its receipt, the constant current source, by way of its column select switching device, enables an entire column in the array. Given this arrangement, when a row select signal is transmitted along any of rows 25–28 and a column select signal is received by any constant current source, the corresponding tip or tips at the intersection are enabled for driving the display.

Figure 2:
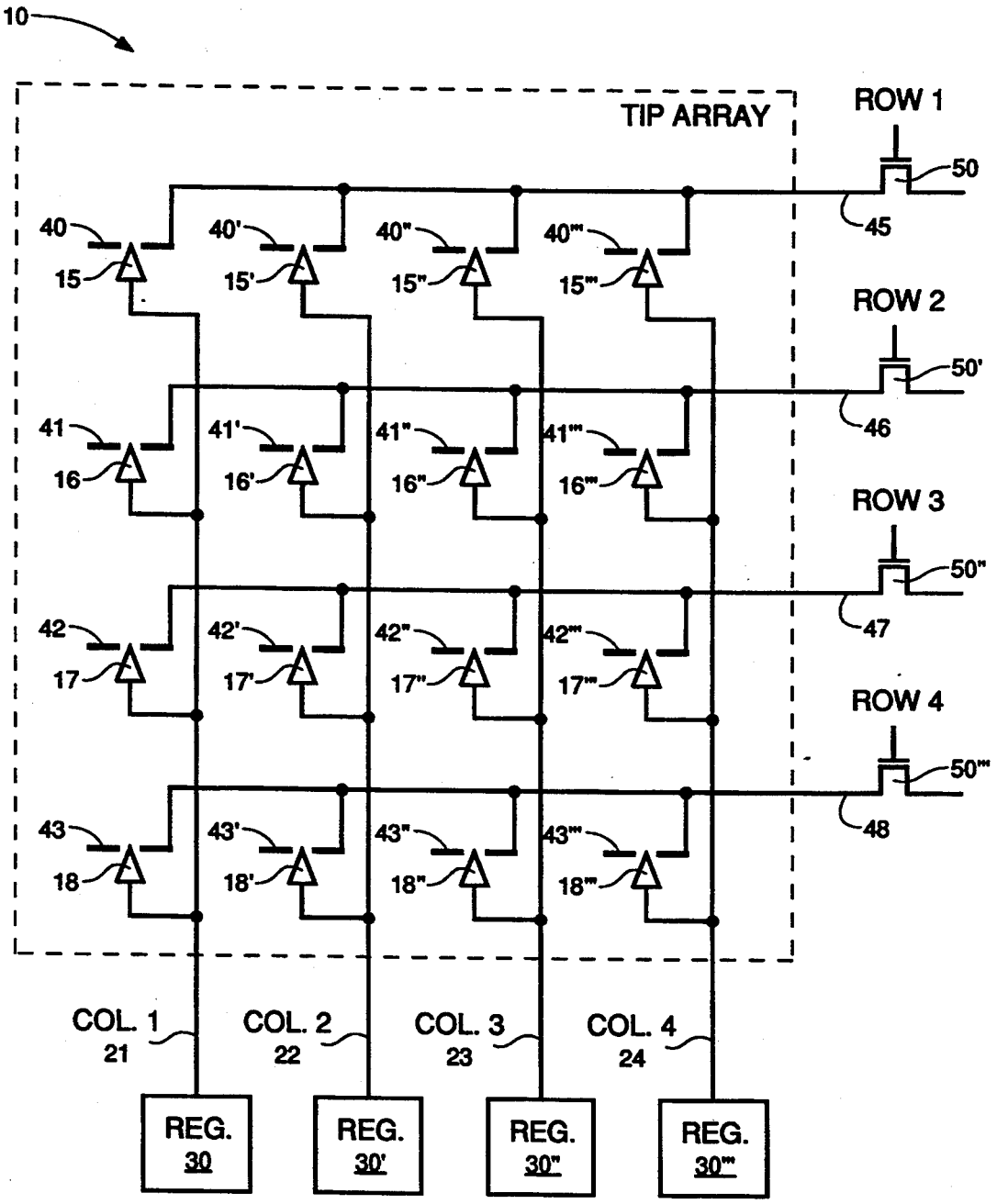
FIG. 2 is a schematic diagram of a flat panel display device employing a second embodiment of the present invention.

Referring to FIG. 2, a flat panel display device 10, preferably a field emission display ("FED"), is illustrated employing a second embodiment of the present invention. Device 10 comprises an array defined by a predetermined number of rows and columns formed within a 3 dimensional periphery or region on a semiconductor substrate. The dashed line in FIG. 2 depicts this periphery. For the purposes of illustration, the array comprises a 4 by 4 matrix addressable array, whereby the four columns are represented by the numbers 21, 22, 23 and 24, and the four rows are represented by the numbers 45, 46, 47 and 48.

In FIG. 2, device 10 comprises an array of field emitter tips 15–18, 15′–18′, 15″–18″, and 15‴–18‴ and display grids 40–43, 40′–43′, 40″–43″, and 40‴–43‴ within the substrate's region. As described hereinabove, electrons are emitted by tips 15–18, 15′–18′, 15″–18″, and 15‴–18‴ through corresponding display grids 40–43, 40′–43′, 40″–43″, and 40‴–43‴ in order to illuminate a phosphorus background and display an image.

In the second embodiment of the present invention, tips 15–18, 15′–18′, 15″–18″, and 15‴–18‴ are driven by a plurality of constant current sources 30, 30′, 30″, and 30‴, formed outside the substrate's region. Utilizing the advantages of FED technology, constant current sources 30, 30′, 30″, and 30‴ may comprise the pixelator driver technology described hereinabove, though viable alternates may also be employed. It should be noted that when taken in combination, tips 15–18, 15′–18′, 15″–18″, and 15‴–18‴ and constant current sources 30, 30′, 30″, and 30‴ provide a means for driving device 10, and more particularly display grids 40–43, 40′–43′, 40″–43″, and 40‴–43‴.

The above architecture is partly realized by the direct coupling of each constant current source 30, 30′, 30″, or 30‴ with one particular column, 21, 22, 23 or 24, of rows 45–48. Thus, the number of constant current sources 30, 30′, 30″, and 30‴ is directly equal to the number of columns in the matrix addressable array. As such, there are 4 constant current sources, 30, 30′, 30″, and 30‴, each being associated with one of columns 21 through 24.

Unlike the first embodiment, each row of the array of this second embodiment comprises a series of row select switches, 50, 50′, 50″, 50‴, formed outside the region of the substrate. Row select switches, 50, 50′, 50″, and 50‴ preferably comprise field effect transistors ("FET") . Further, each row select switch is coupled to a row of the display grid array, thus enabling an entire row upon receiving a row select signal. As such, only 4 row select switches are required.

Furthermore, constant current sources 30, 30′, 30″, and 30‴ each comprise a column select switching device (not shown) formed outside the region of the substrate. Thus, when a particular tip of the array is to be enabled for emission purposes, a column select signal is received by the relevant constant current source. Upon its receipt, the constant current source, by way of its column select switching device, enables an entire column in the array. Given this arrangement, when a row select signal has enabled a row of columns of the display array, those columns having a current generated by the constant current source will cause the tip to emit electrons. Thus, a first tip in the array is enabled to drive a pixel in the display after the row select switch and the column select switch of said first tip are enabled.

While the particular invention has been described with reference to illustrative embodiments, this description is not meant to be construed in a limiting sense. It is understood that although the present invention has been described in a preferred embodiment, various modifications of the illustrative embodiments, as well as additional embodiments of the invention, will be apparent to persons skilled in the art upon reference to this description without departing from the spirit of the invention, as recited in the claims appended hereto. For example, the present invention pertains to a flat panel display, and more particularly, a field emission display. Nonetheless, the inventive features described herein can also be incorporated in LCD technology. Further, while the array is formed within the region of the semiconductor substrate, it should be obvious to one of ordinary skill in the art that the constant current sources, column and/or row select switches can be formed on another substrate entirely. It is therefore contemplated that the appended claims will cover any such modifications or embodiments as fall within the true scope of the invention.

All of the U.S. patents cited herein are hereby incorporated by reference as if set forth in their entirety.

What is claimed is:

1. A display comprising:

a. a phosphorescent screen having a surface comprising a plurality of pixels arranged in a matrix of rows and columns; and b. an integrated circuit adjacent to the screen, the integrated circuit formed on a substrate, the integrated circuit comprising:

(1) a grid;

(2) addressing means for providing a row signal and a column signal;

(3) a multiplicity of pixelators formed within a periphery on the substrate, the multiplicity arranged to correspond with a row of pixels, each pixelator comprising:

(a) an emitter for emitting electrons through the grid so that a pixel of the plurality is illuminated; and (b) a row switch coupled to the emitter, the row switch having conductivity responsive to the row signal; and c. a current source formed outside the periphery, the current source coupled to each pixelator in the row, the current source for providing electrons for emission when enabled by the column signal.

2. The display of claim 1 wherein the current source and the row switches of the multiplicity of pixelators comprise concurrently formed NMOS circuitry.

3. A field emission display comprising:

a. an active matrix array of pixelators formed in a first plurality of rows and a second plurality of columns, each pixelator comprising an addressing transistor, each pixelator being a member of one row and of one column, the rows and columns within a periphery on an integrated circuit substrate;

b. identifying means, formed on the integrated circuit substrate, for providing a row signal and a column signal for identifying a pixelator, the identified pixelator being at the intersection of a predetermined row and a predetermined column, the identified pixelator responsive to the row signal;

c. a third plurality, equal in number to the second plurality, of drive means, formed on the integrated circuit substrate outside the periphery, each drive means for providing a drive signal responsive to the column signal; and d. busing means, formed on the integrated circuit substrate, for respectively coupling the drive signal of each drive means to a respective fourth plurality of pixelators, each pixelator of each fourth plurality being a member of one column, so that the identified pixelator displays a pixel responsive to the respective drive signal.

4. The display of claim 3 wherein the identified pixelator comprises:

a. a field emission tip coupled to the busing means; and b. means for row selection coupled in series between the tip and the busing means.

* * * * *